US011370237B2

(12) United States Patent
Honda

(10) Patent No.: US 11,370,237 B2
(45) Date of Patent: Jun. 28, 2022

(54) ROLL MEDIUM HOLDING DEVICE AND IMAGE FORMING APPARATUS INCORPORATING SAME

(71) Applicant: Ricoh Company, Ltd., Tokyo (JP)

(72) Inventor: Ryo Honda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/236,431

(22) Filed: Apr. 21, 2021

(65) Prior Publication Data

US 2021/0339545 A1 Nov. 4, 2021

(30) Foreign Application Priority Data

May 1, 2020 (JP) ..... JP2020-081390
Mar. 17, 2021 (JP) ..... JP2021-043881

(51) Int. Cl.

| | |
|---|---|
| ***B41J 13/08*** | (2006.01) |
| ***B65H 75/24*** | (2006.01) |
| ***B41J 15/04*** | (2006.01) |
| *B41J 2/01* | (2006.01) |

(52) U.S. Cl.

CPC ..... *B41J 13/08* (2013.01); *B41J 15/046* (2013.01); *B65H 75/245* (2013.01); *B65H 75/246* (2013.01); *B41J 2/01* (2013.01)

(58) Field of Classification Search

CPC . B41J 13/08; B41J 15/046; B41J 2/01; B65H 75/246; B65H 75/245

See application file for complete search history.

(56) References Cited

U.S. PATENT DOCUMENTS

| | | | | |
|---|---|---|---|---|
| 3,018,977 | A | 1/1962 | Skallquist | |
| 3,097,808 | A | 7/1963 | Williams | |
| 4,149,682 | A * | 4/1979 | Gustafson | B65H 75/242 242/573 |
| 2004/0214699 | A1* | 10/2004 | Kim | B65H 75/08 492/17 |
| 2012/0273602 | A1 | 11/2012 | Sperry et al. | |

(Continued)

FOREIGN PATENT DOCUMENTS

| | | |
|---|---|---|
| CN | 202805955 U | 3/2013 |
| CN | 202826758 U | 3/2013 |

(Continued)

OTHER PUBLICATIONS

Extended European Search Report dated Sep. 14, 2021 in European Patent Application No. 21170117.2, 7 pages.

(Continued)

*Primary Examiner* — Yaovi M Ameh
(74) *Attorney, Agent, or Firm* — Xsensus LLP

(57) ABSTRACT

A roll medium holding device rotatably holds a roll medium. The roll medium holding device includes a medium positioning portion including an inclined surface that contacts an end of the roll medium and a medium holder that is swingable around an axis parallel to a rotation axis of the roll medium and movable in a radial direction of the roll medium. The medium holder presses an inner circumferential surface of the roll medium in a direction from the rotation axis of the roll medium toward the inner circumferential surface of the roll medium.

8 Claims, 11 Drawing Sheets

(56) References Cited

U.S. PATENT DOCUMENTS

| | | | | |
|---|---|---|---|---|
| 2016/0130110 | A1* | 5/2016 | Honda | B65H 75/242<br>242/574 |
| 2017/0217719 | A1 | 8/2017 | Honda | |
| 2018/0257902 | A1 | 9/2018 | Honda | |
| 2019/0283472 | A1 | 9/2019 | Honda | |
| 2019/0284007 | A1 | 9/2019 | Honda | |

FOREIGN PATENT DOCUMENTS

| | | | |
|---|---|---|---|
| CN | 110356128 | A | 10/2019 |
| DE | 20 2015 009 188 | U1 | 11/2016 |
| EP | 2 845 830 | A1 | 3/2015 |
| JP | 2003-266845 | | 9/2003 |
| JP | 2007-290865 | | 11/2007 |
| JP | 2016-102029 | | 6/2016 |

OTHER PUBLICATIONS

Office Action dated May 9, 2022 in Chinese Patent Application No. 202110423174.9, 7 pages.

* cited by examiner

ROLL MEDIUM HOLDING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2020-081390, filed on May 1, 2020 and 2021-043881, filed on Mar. 17, 2021, in the Japan Patent Office, the entire disclosure of each of which is hereby incorporated by reference herein.

BACKGROUND

Technical Field

Embodiments of the present disclosure relate to a roll medium holding device and an image forming apparatus incorporating the roll medium holding device.

Description of the Related Art

There is known a roll medium holding device that holds a roll medium. The roll medium is a continuous sheet medium (hereinafter referred to as a "medium") that is wound in a roll. The roll medium holding device carries the medium out of the roll medium. There is also known an image forming apparatus that includes the roll medium holding device and a medium winding device. The image forming apparatus forms an image on the medium conveyed from the roll medium. The medium winding device is disposed opposite the roll medium holding device. The roll medium is formed by winding the medium around a core material which is a hollow cylinder.

SUMMARY

Embodiments of the present disclosure describe an improved roll medium holding device that rotatably holds a roll medium. The roll medium holding device includes a medium positioning portion including an inclined surface that contacts an end of the roll medium and a medium holder that is swingable around an axis parallel to a rotation axis of the roll medium and movable in a radial direction of the roll medium. The medium holder presses an inner circumferential surface of the roll medium in a direction from the rotation axis of the roll medium toward the inner circumferential surface of the roll medium.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
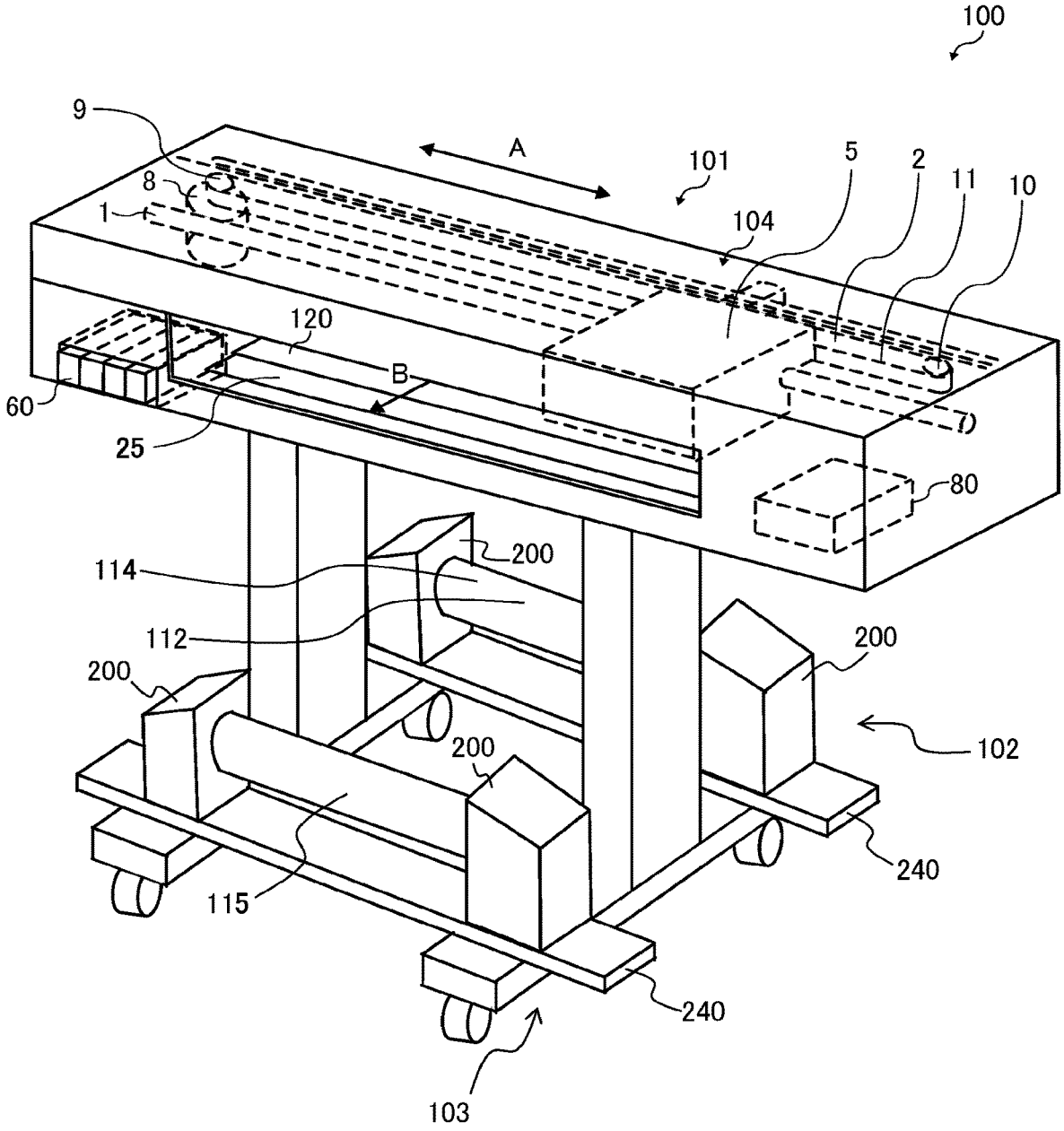
FIG. 1 is a partially transparent perspective view of an image forming apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

Figure 2:
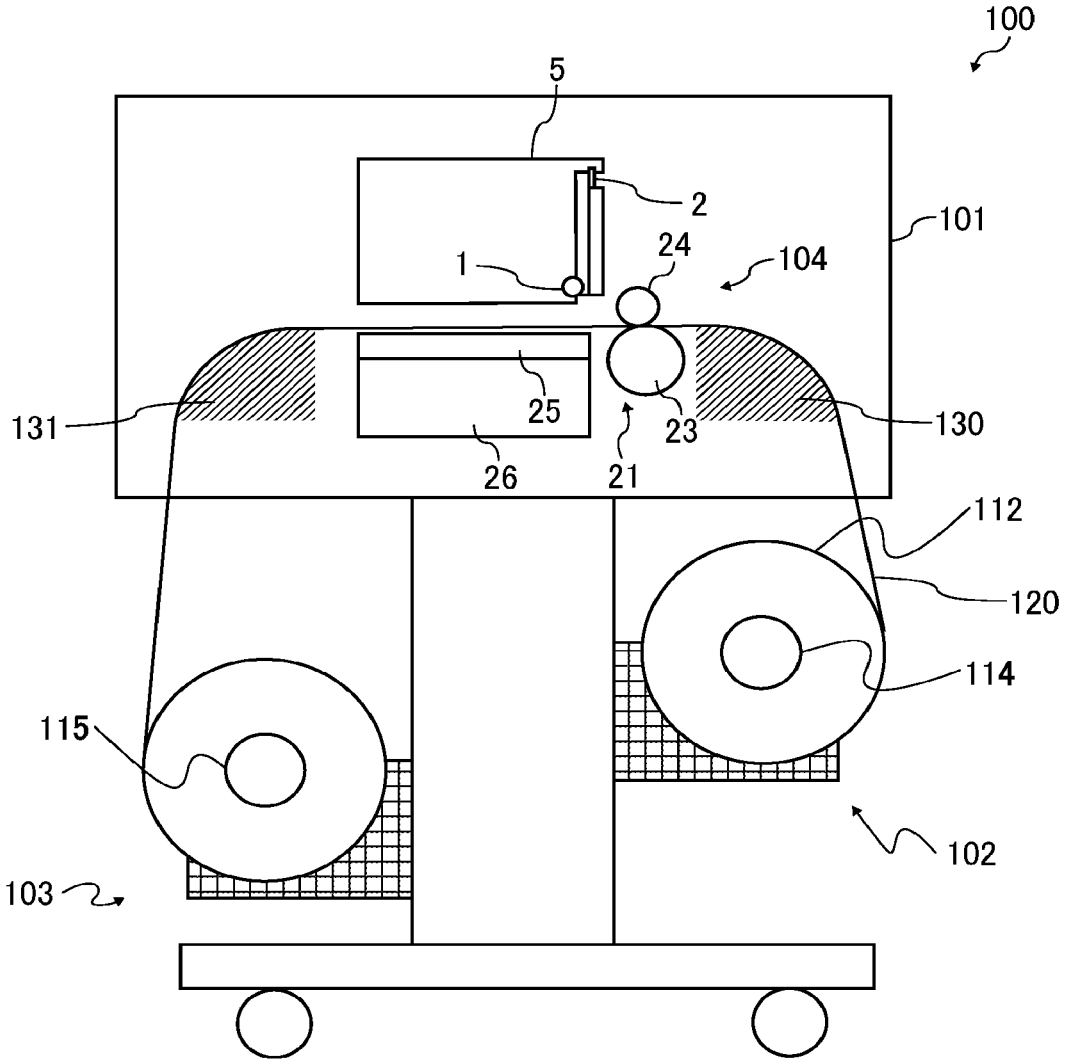
FIG. 2 is a schematic side view of the image forming apparatus according to embodiments of the present disclosure.
Figure 3:
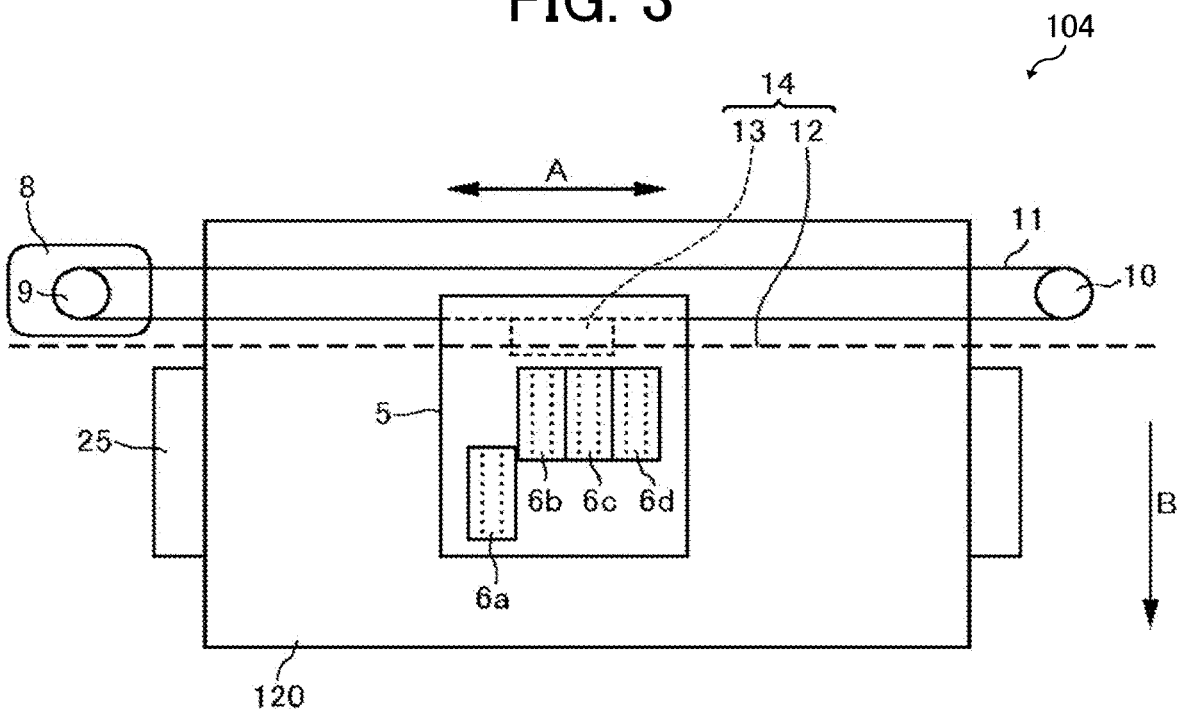
FIG. 3 is a partially transparent plan view of an image forming unit included in the image forming apparatus according to embodiments of the present disclosure.

Hereinafter, embodiments of the present disclosure are described with reference to the drawings. Descriptions are given of an inkjet printer 100 as an embodiment of an image forming apparatus including a roll medium holding device according to the present disclosure with reference to FIGS. 1 to 3. FIG. 1 is a perspective view illustrating an exterior of the inkjet printer 100. FIG. 2 is a schematic side view of the inkjet printer 100. FIG. 3 is a plan view illustrating a part of an image forming unit 104 included in the inkjet printer 100.

As illustrated in FIG. 1, the inkjet printer 100 is a serial type image forming apparatus, and includes an apparatus body 101, a sheet feeding device 102 disposed below the apparatus body 101, and a winding device 103 disposed opposite the sheet feeding device 102. The sheet feeding device 102 may be disposed below the apparatus body 101 separately from the apparatus body 101, or may be combined with the apparatus body 101 as illustrated in FIG. 2. Similarly to the sheet feeding device 102, the winding device 103 may be disposed below the apparatus body 101 separately from the apparatus body 101, or may be combined with the apparatus body 101 as illustrated in FIG. 2. An image forming unit 104 is disposed inside the apparatus body 101 as illustrated in FIG. 2. The sheet feeding device 102 feeds a sheet 120 from a rolled sheet 112 to the image forming unit 104, the image forming unit 104 forms an image on the sheet 120, and the winding device 103 wind the sheet 120 on which the image is formed. The rolled sheet 112 is formed by winding the sheet 120 (continuous sheet medium) in a roll.

The image forming unit 104 includes a carriage 5, a guide rod 1, and the guide stay 2. The guide rod 1 and the guide stay 2 are hung between both side plates of the apparatus body 101 as a guide and movably support the carriage 5 in the direction indicated by arrow A in FIGS. 1 and 3, which is the main scanning direction and the direction of movement of the carriage 5. As illustrated in FIG. 3, in the image forming unit 104, a main scanning motor 8 as a driving source to reciprocate the carriage 5 is disposed on one side in the main scanning direction. The main scanning motor 8 rotates a drive pulley 9. A timing belt 11 is wound around the drive pulley 9 and a driven pulley 10 disposed on the other side in the main scanning direction. A belt holding portion of the carriage 5 is secured to the timing belt 11. As the main scanning motor 8 is driven, the carriage 5 is reciprocated in the main scanning direction.

Multiple recording heads 6*a* to 6*d* (see FIG. 3) are mounted on the carriage 5. Each of the recording heads 6*a* to 6*d* integrally includes a liquid discharge head that discharges liquid to a medium (e.g., the sheet 120) to form an image and a head tank that supplies the liquid to the liquid discharge head. In the following description, when the multiple recording heads 6*a* to 6*d* are not individually distinguished, the respective recording heads 6*a* to 6*d* are simply described as the "recording head 6" or collectively described as the "recording heads 6".

The recording head 6*a* is disposed one head (length of nozzle array) away from the recording heads 6*b* to 6*d* in the sub-scanning direction indicated by arrow B. The sub-scanning direction is perpendicular to the main scanning direction. The recording head 6 includes a nozzle array including a plurality of nozzles arranged in the sub-scanning direction perpendicular to the main scanning direction, and discharges liquid downward from the nozzles.

Each of the recording heads 6*a* to 6*d* has two nozzle arrays. Each of the recording heads 6*a* and 6*b* discharges droplets of black from the two nozzle arrays. That is, the droplets of the same color are discharged from both the two nozzle arrays. The recording head 6*c* discharges droplets of cyan (C) from one nozzle array, and the other nozzle array is unused. The recording head 6*d* discharges droplets of magenta (M) from one nozzle array and discharges droplets of yellow (Y) from the other nozzle array.

As a result, the inkjet printer 100 can form a monochrome image corresponding to the width of two recording heads 6 by one scan in the main scanning direction with the recording heads 6*a* and 6*b*, and can form a color image with the recording heads 6*b* to 6*d*, for example. Note that the configuration of the recording heads 6 is not limited as described above, and a plurality of recording heads may all be arranged in the main scanning direction.

An encoder sheet 12 is disposed along the direction of movement of the carriage 5, and an encoder sensor 13 to read the encoder sheet 12 is mounted on the carriage 5. The encoder sheet 12 and the encoder sensor 13 construct a linear encoder 14. The position and speed of the carriage 5 are detected from the output of the linear encoder 14.

A conveyor 21 (see FIG. 2) conveys the sheet 120 fed from the rolled sheet 112 by the sheet feeding device 102 to a recording area of a main scanning region of the carriage 5. The sheet 120 is intermittently conveyed in the direction of conveyance of the sheet 120, which is the same as the sub-scanning direction indicate by arrow B and perpendicular to the main scanning direction of the carriage 5. As illustrated in FIG. 1, ink of each color is supplied to the head tank of the recording head 6 via a supply tube from an ink cartridge 60 which is a main tank replaceably installed in the apparatus body 101. A maintenance unit 80 to maintain and recover a discharge function of the recording heads 6 is disposed next to a conveyance guide 25 on one side in the main-scanning direction of the carriage 5 as illustrated in FIG. 1.

As illustrated in FIG. 2, the conveyor 21 includes a conveyance roller 23 to convey the sheet 120 fed from the rolled sheet 112 by the sheet feeding device 102 and a pressure roller 24 disposed opposite the conveyance roller 23. The conveyor 21 further includes the conveyance guide 25 in which a plurality of suction holes is formed and a suction fan 26 as a suction device that sucks air through the plurality of suction holes of the conveyance guide 25. The conveyance guide 25 and the suction fan 26 are disposed downstream from conveyance roller 23. The inkjet printer 100 includes a cutter to cut the sheet 120, on which an image has been printed by the recording heads 6, at a predetermined length. The cutter is disposed downstream from the conveyor 21.

The rolled sheet 112 as a roll medium loaded in the sheet feeding device 102 is obtained by winding the sheet 120, which corresponds to the continuous sheet medium, around a hollow shaft 114 such as a paper tube serving as a core material. In the rolled sheet 112 according to the present embodiment, the end of the sheet 120 may be secured to the hollow shaft 114 by adhesion such as gluing, or may not be secured to the hollow shaft 114. Such a rolled sheet 112 can be loaded in the sheet feeding device 102.

As illustrated in FIG. 2, the inkjet printer 100 includes a guide 130 and a sheet ejection guide 131 in the apparatus body 101. The guide 130 guides the sheet 120 pulled out of the rolled sheet 112 in the sheet feeding device 102. The sheet ejection guide 131 guides the sheet 120 that has passed the conveyance guide 25 on which the sheet 120 is sucked. The winding device 103 includes a hollow shaft 115 such as a paper tube serving as the core material. The leading end of the sheet 120 pulled out of the rolled sheet 112 is adhered to the hollow shaft 115 with a tape or the like.

With such a configuration, the inkjet printer 100 reciprocally moves the carriage 5 in the main scanning direction and intermittently conveys the sheet 120 fed from the sheet feeding device 102 by the conveyor 21 during image formation. Then, the inkjet printer 100 drives the recording heads 6 in accordance with image data (print data) to discharge droplets, thereby forming a desired image on the sheet 120. The sheet 120 on which the image is formed is guided by the sheet ejection guide 131 and wound around the hollow shaft 115 in the winding device 103. The sheet 120 is conveyed on the conveyance roller 23 while tension is applied from each of the sheet feeding device 102 and the winding device 103. Each tension affects the conveyance accuracy.

Figure 4:
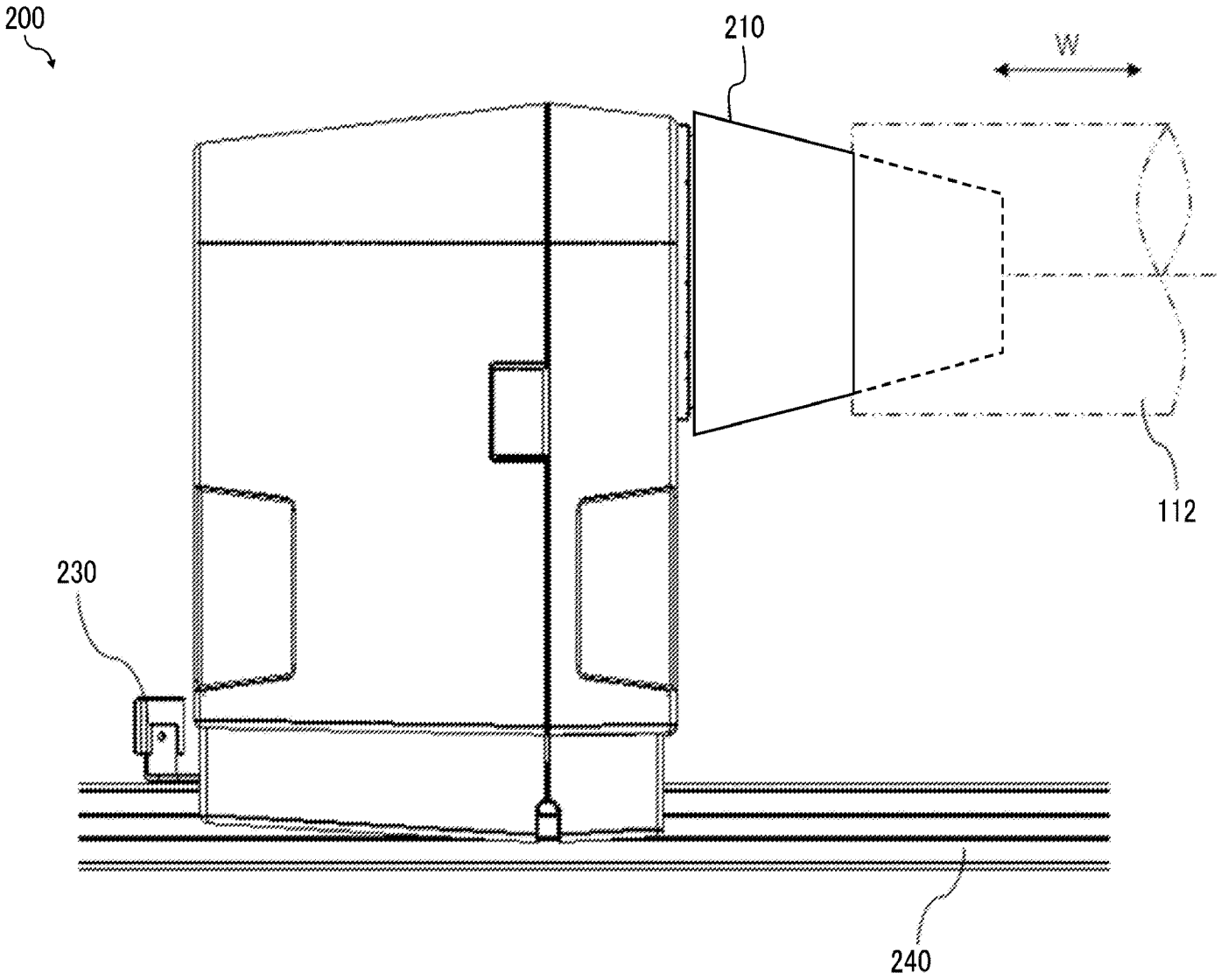
FIG. 4 is a schematic side view of a roll holding device as a roll medium holding device according to embodiments of the present disclosure.
Figure 5:
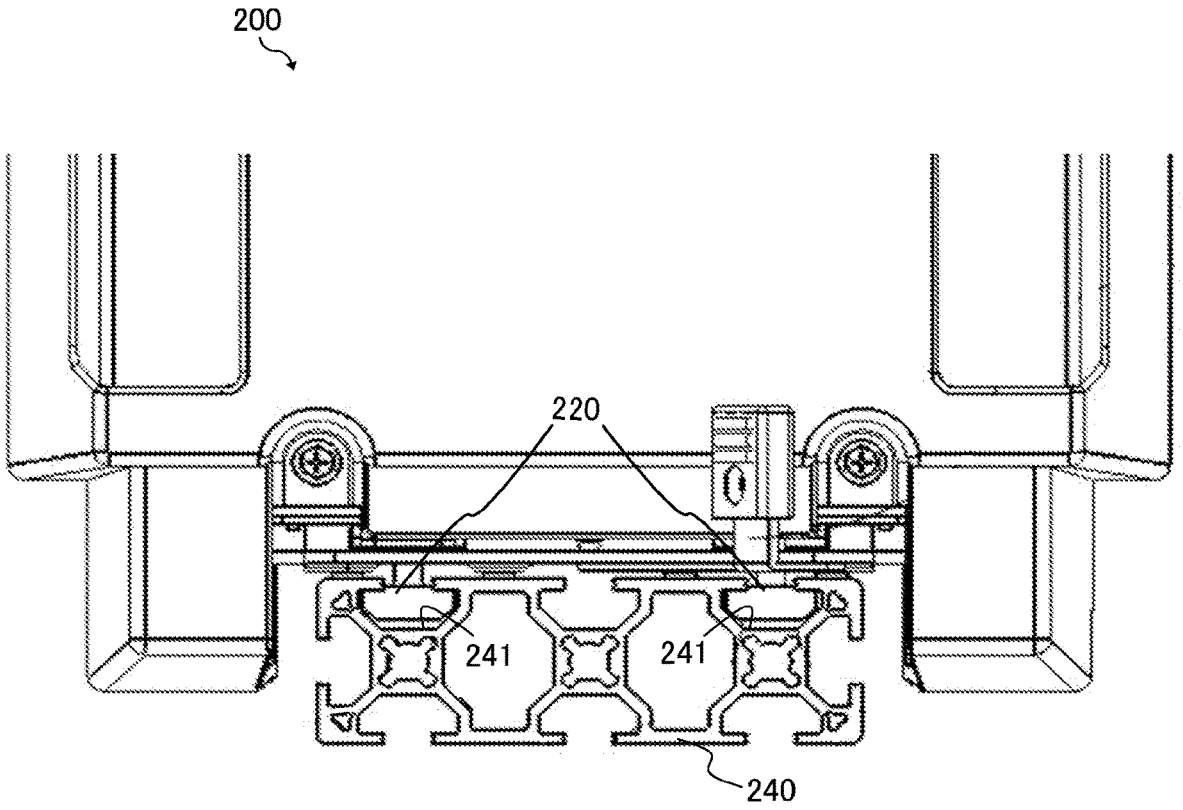
FIG. 5 is a schematic rear view of the roll holding device.

Next, a description is given of a roll holding device 200 as an embodiment of a roll medium holding device according to the present disclosure. FIG. 4 is a schematic side view illustrating the overall configuration of the roll holding device 200. FIG. 5 is a schematic rear view of the roll holding device 200. As illustrated in FIG. 1, the pair of the roll holding devices 200 hold both ends of the rolled sheet 112. Thus, the roll holding device 200 is used in pairs. Hereinafter, only one of the pair of roll holding devices 200 is described. The roll holding devices 200 having the same configuration are disposed at both ends of the rolled sheet 112 so as to hold both the ends of the rolled sheet 112. The sheet 120 is conveyed from the rolled sheet 112 held by the roll holding devices 200 in the inkjet printer 100 as described above.

As illustrated in FIGS. 4 and 5, the roll holding device 200 has a substantially quadrangular prism shape in appearance and includes a core holding mechanism 210 on one of side faces thereof facing a position where the rolled sheet 112 is held. The roll holding devices 200 includes a slider 220 and a lock lever 230. A guide rail 240 as a guide holds the roll holding device 200 via the slider 220, and the roll holding device 200 is slidable on the guide rail 240 only in one direction. As illustrated in FIG. 1, the guide rail 240 serves as a part of the sheet feeding device 102 and the winding device 103, and movably holds the roll holding devices 200 along the direction parallel to the direction indicated by arrow A in FIG. 1.

The core holding mechanism 210 is fitted into the hollow shaft (hollow shaft 114 or 115) of the rolled sheet 112 and holds the rolled sheet 112 at a predetermined position. The core holding mechanism 210 is described in more detail later. The slider 220 is a movement guide that enables the core holding mechanism 210 to move in a width direction W of the rolled sheet 112 in FIG. 4 and inhibit the core holding mechanism 210 from moving in the direction perpendicular to the width direction W. As illustrated in FIG. 5, the guide rail 240 includes a guide groove 241. The slider 220 moves along the guide groove 241 in the width direction W of the rolled sheet 112 and is inhibited from moving in the direction perpendicular to the width direction W by the guide groove 241. The slider 220 is disposed on the bottom surface of the housing of the roll holding device 200.

Although the guide rail 240 movably holds the roll holding device 200 in the width direction W with the slider 220, the lock lever 230 is a movement restrictor that restricts the roll holding device 200 from moving in the width direction W. When the lock lever 230 is operated, the slider 220 transitions from a state in which the slider 220 is not pressed against the inner wall of the guide groove 241 to a state in which the slider 220 is pressed against the inner wall of the guide groove 241. The frictional force applied by the operation of the lock lever 230 restricts the roll holding device 200 from moving. When the lock lever 230 is operated in reverse, the slider 220 transitions from the state in which the slider 220 is pressed against the inner wall of the guide groove 241 to the state in which the slider 220 is not pressed against the inner wall of the guide groove 241. By this operation of the lock lever 230, the frictional force is not applied, and the roll holding device 200 can be moved.

That is, by operating the lock lever 230, the roll holding devices 200 can transition between a state in which the movement of the rolled sheet 112 in the width direction W is restricted (locked state) and a state in which the movement is not restricted (unlocked state). The lock lever 230 is disposed on the side face opposite the side face on which the core holding mechanism 210 is disposed. That is, the lock lever 230 is disposed on the side opposite the side on which the rolled sheet 112 is held to facilitate a user operating the lock lever 230.

As illustrated in FIG. 5, the slider 220 is a projection attached to the bottom surface of the roll holding device 200. The slider 220 is inserted into an opening part of the guide groove 241 provided in the guide rail 240 from the end of the guide groove 241 in the width direction W of the rolled sheet 112. Thus, the slider 220 is movable in the width direction W. The slider 220 is inhibited from moving in the direction perpendicular to the width direction W of the rolled sheet 112 because the slider 220 collides with the inner wall of the guide groove 241.

As illustrated in FIG. 1, each of the sheet feeding device 102 and the winding device 103 includes the guide rail 240. The respective guide rails 240 are disposed along the longitudinal direction of the hollow shaft 114 secured to the sheet feeding device 102 and the hollow shaft 115 secured to the winding device 103. The guide rail 240 is longer than the width of the rolled sheet 112 and couples the bottom surfaces of the roll holding devices 200 at both ends of the rolled sheet 112 in each of the sheet feeding device 102 and the winding device 103.

When the rolled sheet 112 is secured by the pair of roll holding devices 200 included in the sheet feeding device 102, one of the pair of roll holding devices 200 holds one end of the hollow shaft 114 that is the hollow portion of the rolled sheet 112. Then, the other of the pair of roll holding devices 200 is moved toward the other end of the hollow shaft 114 to hold the rolled sheet 112, and the lock lever 230 is operated to lock the roll holding device 200, thereby securing the position of the rolled sheet 112 in the width direction W. At this time, the roll holding devices 200 can be moved and locked so as to secure a center of core (rotation axis) of the rolled sheet 112. Therefore, with such a simple operation, the center of core of the rolled sheet 112 can be secured and held at the predetermined position.

Figure 6:
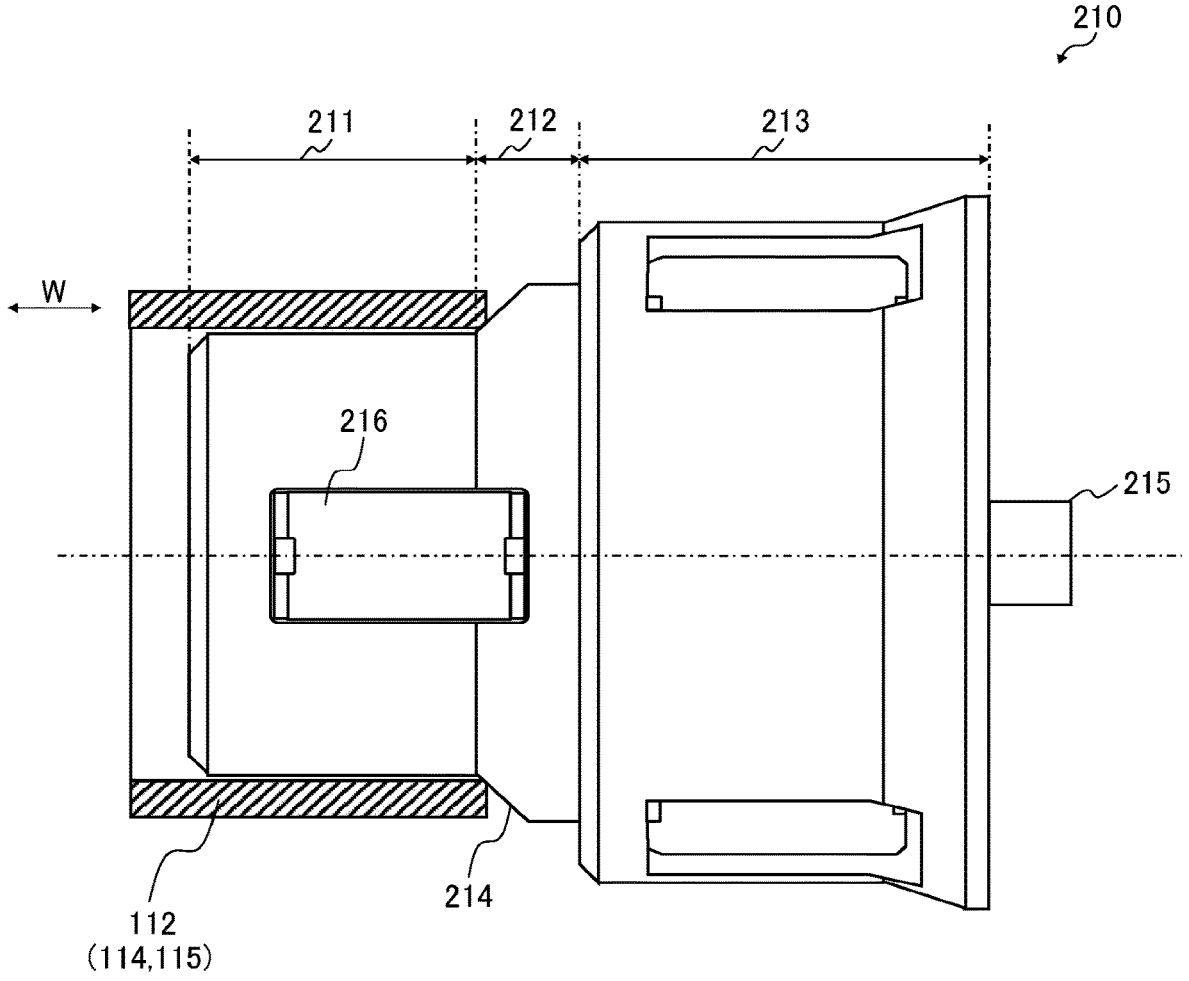
FIG. 6 is a schematic side view of a core holding mechanism included in the roll holding device.

Next, a description is given of a more detailed structure of the core holding mechanism 210 that secures and holds the center of core of the rolled sheet 112. FIG. 6 illustrates a side view of the core holding mechanism 210. As illustrated in FIG. 6, the core holding mechanism 210 can be roughly divided into three portions in the width direction W of the rolled sheet 112. That is, the core holding mechanism 210 includes a medium insertion portion 211, a medium positioning portion 212, and a holding rotation portion 213.

The medium insertion portion 211 is a cylindrical portion having a diameter that can be inserted and fitted into the hollow shaft 114 (or the hollow shaft 115) serving as the core material of the rolled sheet 112, and temporarily holds the end of the rolled sheet 112 immediately after insertion. A plurality of medium holders 216 are disposed on the outer circumferential surface of the medium insertion portion 211.

The medium positioning portion 212 has an inclined surface 214 that contacts the end of the rolled sheet 112. The inclined surface 214 has an inclined annular shape whose diameter increases from the medium insertion portion 211 toward the holding rotation portion 213. The roll holding devices 200 are locked on the guide rail 240 in a state in which the end of the rolled sheet 112 is in contact with the inclined surface 214. As a result, the center of core of the rolled sheet 112 is secured at the predetermined position. Since the inclined surface 214 is inclined, even if the inner diameter of the core material of the rolled sheet 112 varies, the core holding mechanism 210 can hold the rolled sheet 112 at a position with the minimized deviation from the predetermined position (i.e., the desirable position of the center of core of the rolled sheet 112).

The holding rotation portion 213 is disposed on the one side face of the roll holding device 200 and rotatably held by a core central shaft 215 extending in the width direction W of the rolled sheet 112. That is, the holding rotation portion 213 rotates around a rotation axis of the core central shaft 215, and the core holding mechanism 210 rotatably hold the rolled sheet 112 with the inclined surface 214 and the medium insertion portion 211. As a result, the rotation axis of the rolled sheet 112 can be positioned with high accuracy.

Figure 7:
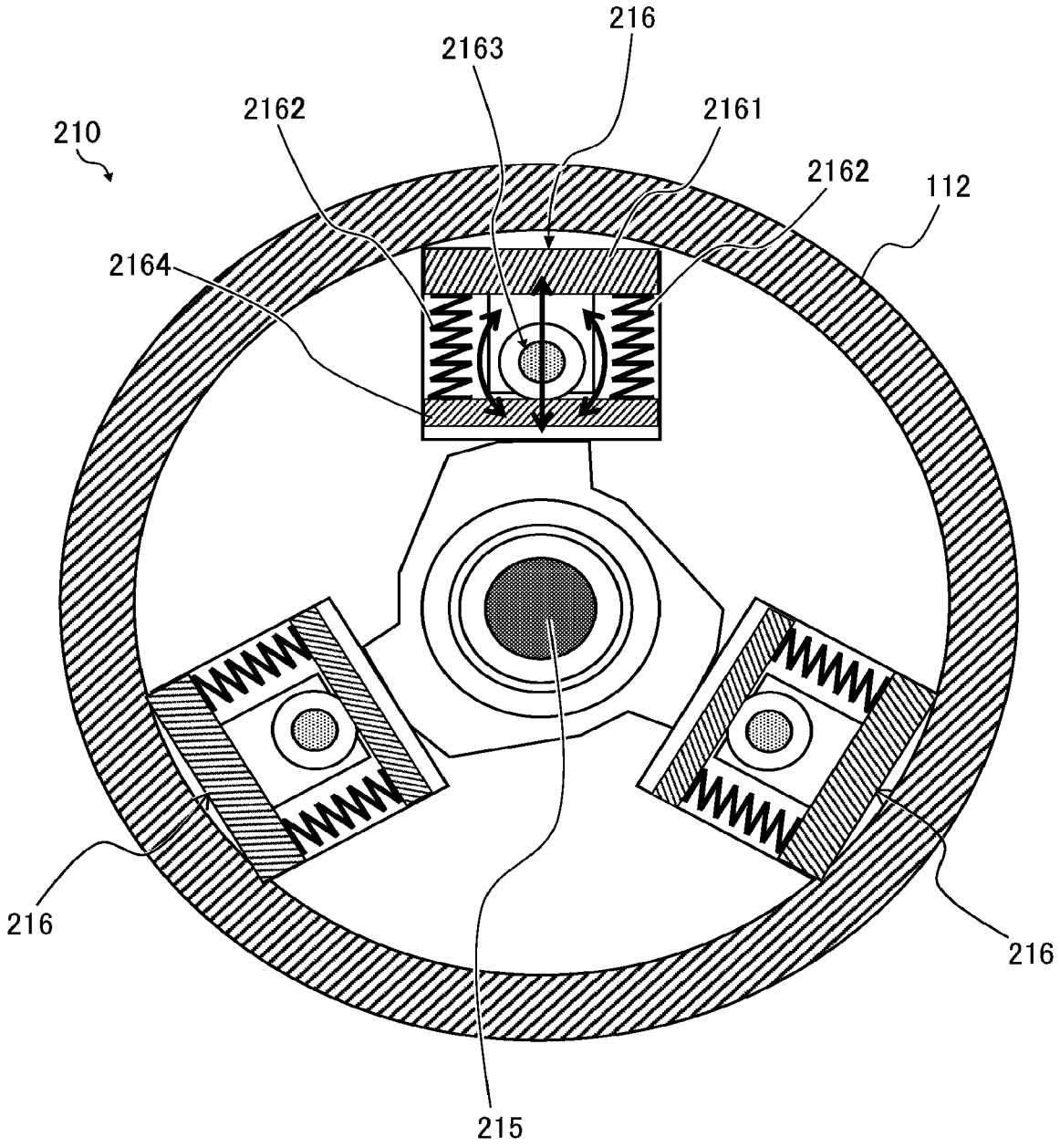
FIG. 7 is a cross-sectional front view of the core holding mechanism included in the roll holding device.

FIG. 7 is a cross-sectional front view of the core holding mechanism 210. As illustrated in FIG. 7, the medium holders 216 are arranged at equal intervals (intervals of 120 degrees) in a circumferential portion of the core holding mechanism 210 around the rotation axis of the core central shaft 215, that is, in a rotation direction of the rolled sheet 112. Each of the medium holders 216 includes a contact part 2161 to contact the inner circumferential surface of the rolled sheet 112. The contact parts 2161 are pressed outward in the radial direction of the medium insertion portion 211 by a biasing force of individual elastic parts. That is, the medium holder 216 presses the inner circumferential surface of the rolled sheet 112. Further, the medium holders 216 are held by individual support shafts inside the medium insertion portion 211. The support shaft swingably holds the contact part 2161. The contact part 2161 is swingably held by the support shaft within a predetermined angle.

Figure 8:
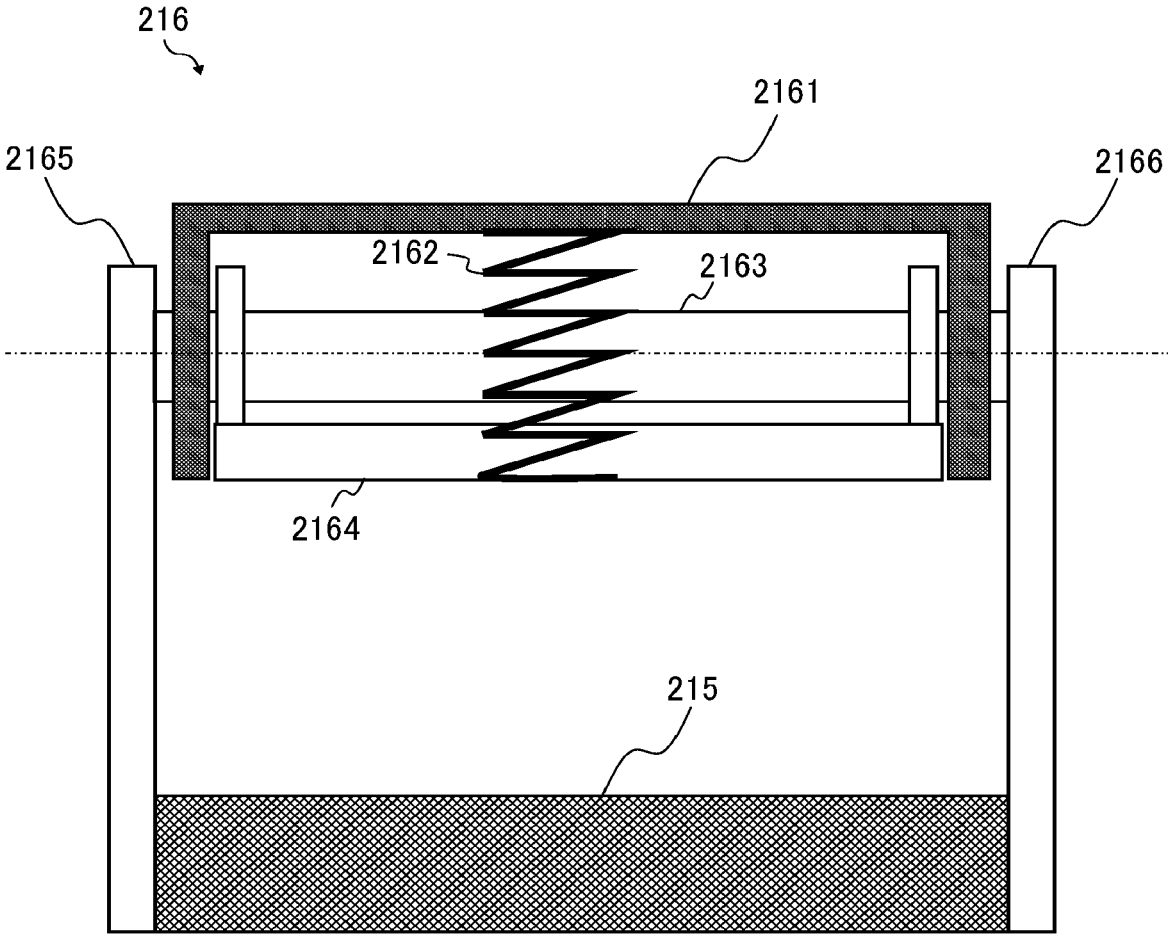
FIG. 8 is a schematic side view of a medium holder included in the roll holding device according to a first embodiment of the present disclosure.
Figure 9:
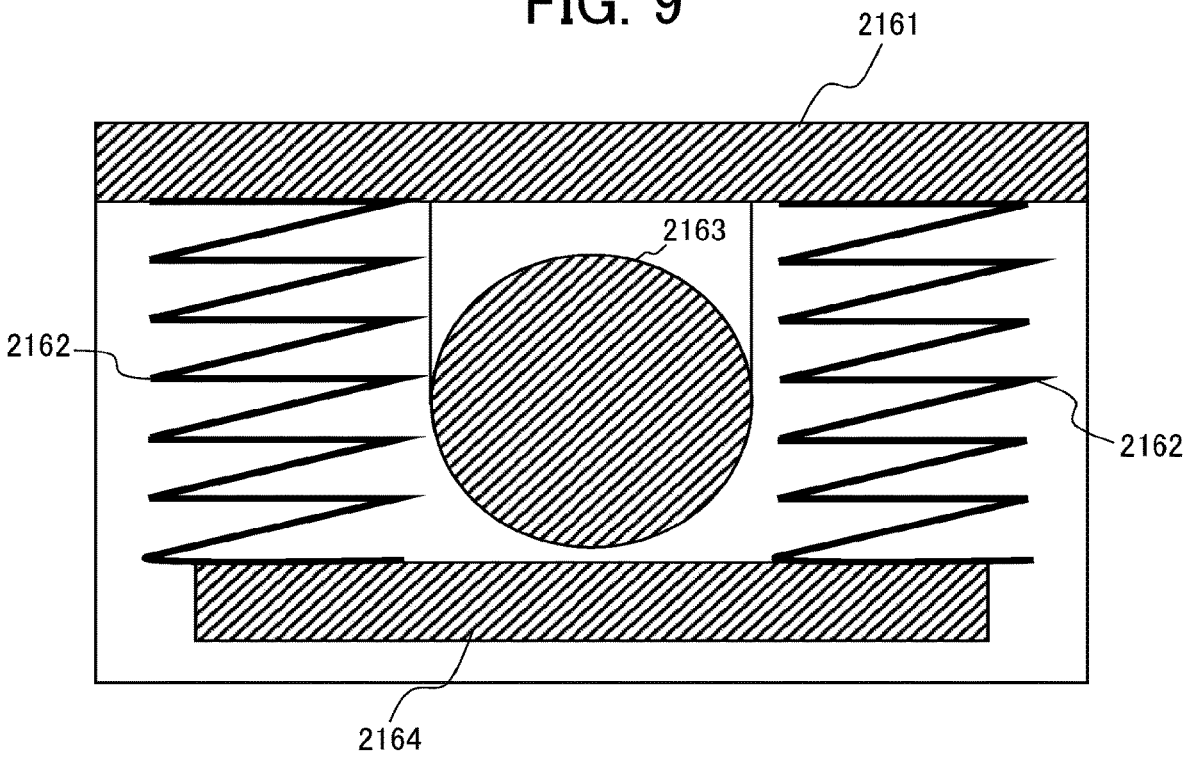
FIG. 9 is a cross-sectional front view of the medium holder according to the first embodiment.

Next, a first embodiment of the medium holder 216 is described with reference to FIGS. 8 and 9. FIG. 8 is a schematic side view of the medium holder 216 according to the present embodiment. FIG. 9 is a schematic front view of the medium holder 216 according to the present embodiment. As illustrated in FIG. 8, the medium holder 216 includes a holder support shaft 2163 as the support shaft stationarily supported by a pair of support plates 2165 and 2166. The support plates 2165 and 2166 extend in the radial direction from the core central shaft 215. The contact part 2161 that contacts the inner circumferential surface of the hollow portion of the rolled sheet 112 is swingably held by the holder support shaft 2163.

The contact part 2161 is paired with a spring fixing plate 2164 disposed opposite the contact part 2161 across the holder support shaft 2163. As illustrated in FIG. 9, a spring 2162 as the elastic part is disposed between the contact part 2161 and the spring fixing plate 2164. The spring 2162 is, for example, a compression spring. The spring fixing plate 2164 as a fixing part is secured to the holder support shaft 2163. One end of the spring 2162 is secured to the spring fixing plate 2164, and the other end of the spring 2162 is secured (in contact with) the contact part 2161. The multiple springs 2162 are disposed across the holder support shaft 2163. The springs 2162 press the contact part 2161 outward in the radial direction of the rolled sheet 112. That is, the contact part 2161 is swingable around an axis parallel to the rotation axis of the rolled sheet 112 by the support of the holder support shaft 2163 and movable in the radial direction of the rolled sheet 112 by the biasing force of the spring 2162.

With the medium holder 216 according to the present embodiment described above, when the medium insertion portion 211 is inserted into the rolled sheet 112 as illustrated in FIG. 7, the spring 2162 presses the edge of the contact part 2161 against the inner circumferential surface of the hollow portion of the core material of the rolled sheet 112. When the rolled sheet 112 attempts to rotate relative to the roll holding devices 200, the medium holder 216 swings around the axis (holder support shaft 2163) parallel to the axis of the core central shaft 215 due to the frictional force (holding force) of the edge of the contact part 2161 because the edge of the contact part 2161 is pressed against the rolled sheet 112. Then, the medium holders 216 expand in the radial direction of the rolled sheet 112, thereby locking the relative rotation of the rolled sheet 112 held by the roll holding device 200.

Figure 10:
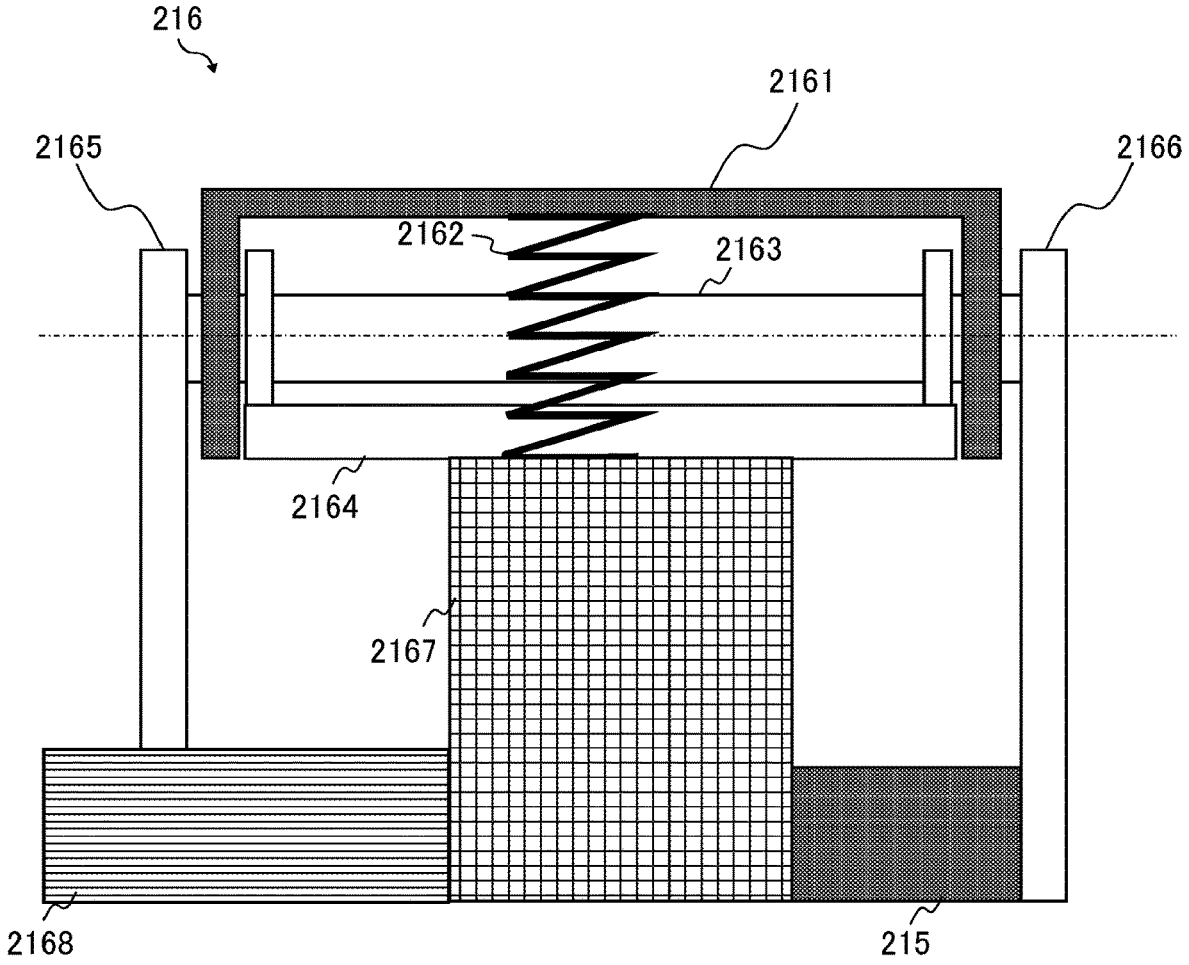
FIG. 10 is a schematic side view of a medium holder included in the roll holding device according to a second embodiment of the present disclosure.
Figure 11:
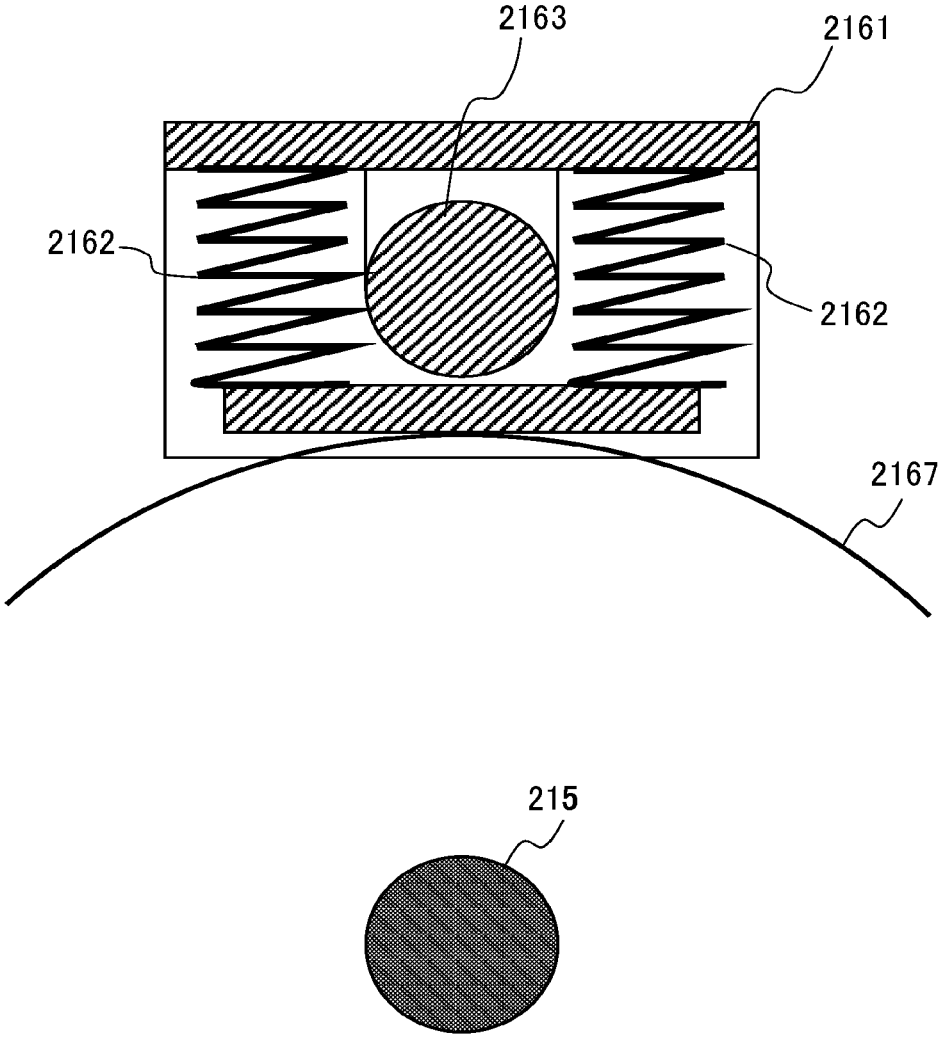
FIG. 11 is a cross-sectional front view of the medium holder according to the second embodiment.

Next, a second embodiment of the medium holder 216 is described with reference to FIG. 10. FIG. 10 is a schematic side view of the medium holder 216 according to the second embodiment. FIG. 11 is a schematic front view of the medium holder 216 according to the second embodiment. As illustrated in FIGS. 10 and 11, in addition to the configuration of the medium holder 216 according to the first embodiment, the medium holder 216 includes a cam 2167 attached to the core central shaft 215 and a cam operation unit 2168 to operate the cam 2167.

As illustrated in FIG. 10, the spring fixing plate 2164 is not secured to the holder support shaft 2163 and is movably supported in the radial direction of the rolled sheet 112 using the holder support shaft 2163 as a guide. The spring fixing plate 2164 is positioned by the cam 2167 in the radial direction of the rolled sheet 112. Therefore, by operating the cam operation unit 2168 to move the cam 2167, the distance of the cam surface of the cam 2167 from the core central shaft 215 can be changed. Since the cam surface of the cam 2167 is in contact with one side of the spring fixing plate 2164, the position of the spring fixing plate 2164 changes in accordance with the change in the position of the cam surface. As the position of the spring fixing plate 2164 changes, the position where the spring 2162 is secured also changes. As the position where the spring 2162 is secured changes, the biasing force applied to the contact part 2161 by the spring 2162 also changes.

That is, in the roll holding device 200 including the medium holder 216 according to the present embodiment, when the rolled sheet 112 is fitted on the core holding mechanism 210, the contact part 2161 can be moved to a position where the contact part 2161 does not contact the inner circumferential surface of the rolled sheet 112 by the operation of the cam 2167. After the rolled sheet 112 is fitted on the core holding mechanism 210, the contact part 2161 is moved to a position where the contact part 2161 contacts the inner circumferential surface of the rolled sheet 112. Therefore, an operation force to fit the rolled sheet 112 on the core holding mechanism 210 can be reduced.

According to the above-described embodiments, the roll holding device 200 includes the tapered portion (inclined surface 214) to position the rolled sheet 112 (roll medium). The tapered portion is provided separately from the medium insertion portion 211. The medium insertion portion 211 serves as a lock mechanism that locks the rotation of the rolled sheet 112 to inhibit the roll medium from moving in the rotation direction of the rolled sheet 112. The lock mechanism includes the medium holder 216 which is swingable around the axis parallel to the rotation axis of the rolled sheet 112 and movable in the radial direction of the rolled sheet 112. Further, the medium holder 216 is pressed toward the inner circumferential surface of the rolled sheet 112 by the elastic part. With these configurations, the roll holding device 200 can improve the positional accuracy of the rolled sheet 112 and enhance the holding force of the rolled sheet 112 in the rotation direction.

As described above, according to the present disclosure, the roll medium holding device can accurately position and hold the roll medium at the predetermined position.

The present disclosure is not limited to specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

What is claimed is:

1. A roll medium holding device for rotatably holding a roll medium, the roll medium holding device comprising:

a medium positioner including an inclined surface to contact an end of the roll medium;

a medium holder being swingable around an axis parallel to a rotation axis of the roll medium and movable in a radial direction of the roll medium, the medium holder to press an inner circumferential surface of the roll medium in a direction from the rotation axis of the roll medium toward the inner circumferential surface of the roll medium; and a support shaft to hold the medium holder, wherein the medium holder includes:

a contact to contact the roll medium and supported by the support shaft;

a fixing position disposed opposite the contact across the support shaft; and an elastic with one end secured to the contact and another end secured to the fixing position, wherein the elastic includes a pair of elastic parts, the elastic parts are disposed across the support shaft, and each of the elastic parts is to press an edge of the contact against the inner circumferential surface of the roll medium in the radial direction.

2. The roll medium holding device according to claim 1, wherein the medium holder includes multiple medium holders arranged at equal intervals in a rotation direction of the roll medium.

3. The roll medium holding device according to claim 1, further comprising:

a cam to change a position of the fixing position; and a cam operator to displace a cam surface of the cam to change the position of the fixing position.

4. An image forming apparatus comprising:

an image generator to form an image on a sheet conveyed from a roll medium; and the roll medium holding device according to claim 1, to hold the roll medium.

5. A roll medium holding device for rotatably holding a roll medium, the roll medium holding device comprising:

means for positioning a medium including an inclined surface to contact an end of the roll medium;

a medium holder being swingable around an axis parallel to a rotation axis of the roll medium and movable in a radial direction of the roll medium, the medium holder to press an inner circumferential surface of the roll medium in a direction from the rotation axis of the roll medium toward the inner circumferential surface of the roll medium; and a support shaft to hold the medium holder, wherein the medium holder includes:

a contact to contact the roll medium and supported by the support shaft;

means for fixing a position disposed opposite the contact across the support shaft; and an elastic with one end secured to the contact and another end secured to the means for fixing a position, wherein the elastic includes a pair of elastic parts, the elastic parts are disposed across the support shaft, and each of the elastic parts is to press an edge of the contact against the inner circumferential surface of the roll medium in the radial direction.

6. The roll medium holding device according to claim 5, wherein the medium holder includes multiple medium holders arranged at equal intervals in a rotation direction of the roll medium.

7. The roll medium holding device according to claim 5, further comprising:

means for changing a position of the means for fixing a position; and means for moving the means for changing to change the position of the means for fixing a position.

8. An image forming apparatus comprising:

image forming means for forming an image on a sheet conveyed from a roll medium; and the roll medium holding device according to claim 5, to hold the roll medium.

* * * * *